United States Patent [19]

Hoerner

[11] 4,027,412

[45] June 7, 1977

[54] ADVERTISING LETTERING AND SUPPORT THEREFOR

[76] Inventor: Eugen Hoerner, Neuer Weg 2,, D-7101 Eberstadt, Germany

[22] Filed: Aug. 11, 1975

[21] Appl. No.: 603,258

[30] Foreign Application Priority Data

Aug. 12, 1974 Germany ..... 2438609

[52] U.S. Cl. ..... 40/125 R

[51] Int. Cl.[2] ..... G09F 7/00

[58] Field of Search ..... 40/125, 130 D, 132 D, 40/140, 142

[56] References Cited

UNITED STATES PATENTS 2,923,080 2/1960 Spangler ..... 40/130 D

FOREIGN PATENTS OR APPLICATIONS 1,351,341 12/1963 France ..... 40/140

291,808 6/1928 United Kingdom ..... 40/140

*Primary Examiner*—Hugh R. Chamblee

*Assistant Examiner*—Wenceslao J. Contreras

*Attorney, Agent, or Firm*—Robert E. Burns; Emmanuel J. Lobato; Bruce L. Adams

[57] ABSTRACT

An advertising lettering support member comprises a U-section bar which is to extend along the entire length of the lettering. The U-shaped bar has a long limb for supporting the lower edge of the lettering, and a short limb having an end portion at right angles to the short limb, for attachment to the rear of the lettering. The rear side of each character and the bar form a hollow four-sided body.

5 Claims, 4 Drawing Figures

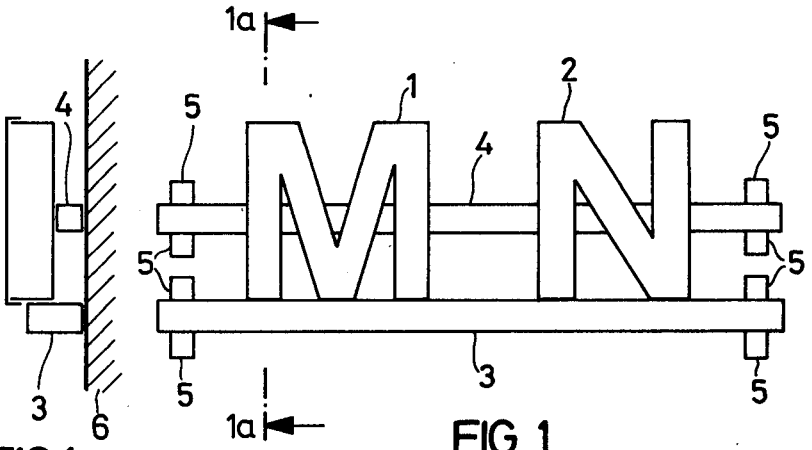
FIG. 1a
FIG. 1
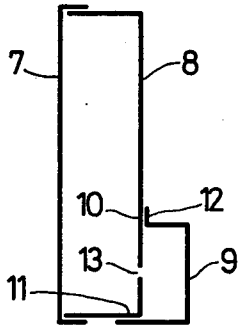
FIG. 2
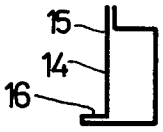
FIG. 3

ADVERTISING LETTERING AND SUPPORT THEREFOR

In advertising lettering which comprises adjacently disposed three dimentional characters, the characters are generally joined together by a common assembly bar when not fixed directly to the wall of a building. In order to save external assembly costs, this joining of the individual characters to the assembly bar to form a complete line of lettering is done directly by the manufacturer. Traditionally, the individual characters are screwed with the required mutual spacing to one or more hollow rectangular bars. In the case of an illuminated line of lettering, the connecting cables run in the hollow bars. The cables are then joined to electrical connections of neon tubes situated in the interior of the characters via holes drilled in one face of the bar.

The traditional construction of such advertising lettering requires a comparatively large amount of time, due to the screwing on of the characters and the drilling of the holes. In the case of large characters, one assembly bar is generally not sufficient on stability grounds, or alternatively further stiffeners must be additionally fixed behind the characters.

According to the invention, there is provided an advertising lettering support member comprising a U-section bar for extending the entire length of the lettering, the U-shape having limbs of different lengths, the longer limb being for supporting the lower edge of the lettering, and the shorter limb having an end portion at right angles to the limb and being for attachment to the rear of the lettering.

The invention also provides advertising lettering consisting of a row of characters joined by a common bar, wherein the bar is of U-shaped cross-section with unequal limbs, and the short limb ends in a portion bent at right angles to the limb, this bent portion being joined to the rear side of each character and the long limb being joined to the underside of each character, in such a manner that the rear side of each character and the bar form a hollow four-sided body. With this means of fixing, a single bar is sufficient for comparatively large characters, since the welding of the rear side gives the character increased stability. The cables can be easily laid in the open bar and led through the openings in the characters without special holes having to be drilled in the bar. Moreover the complete line of lettering can be fixed to the wall of the building with considerable saving of time, as the bar and character are screwed on to the wall together after removing the top of the corresponding character.

Further advantageous details of the invention will be evident from the following description of the embodiment illustrated in the drawing, which is given by way of example, and in which:

FIG. 1 is a front view of two characters, chosen by way of example, of a conventional line of lettering, FIG. 1*a* is a section on the line 1*a*–1*a* through the line of lettering of FIG. 1, FIG. 2 is a section through a character forming part of a line of lettering in accordance with the invention, and FIG. 3 is a section through the space between two characters in the line of lettering shown in FIG. 2.

FIG. 1 and 1*a* show two views of a conventional line of lettering. The characters 1 and 2 are screwed on to the assembly bar 3 through their lower face. A further assembly bar 4 is provided at their rear for strengthening purposes. The bars 3 and 4 are screwed on to the wall 6 of a building by way of side bars 5.

FIG. 2 shows a section through a bar or channel 9 in accordance with the invention. After removing the front face 7, the rear 8 of the character can easily be welded to a vertical bent over marginal portion of the upper limb of the bar 9 and to a projecting marginal portion of the longer lower limb of the bar at the points 10 and 11 respectively. The bent-over marginal portion 12 of the bar may be directed downwardly towards the inside of the U or, as shown upwardly, towards the outside. Electric cables running in the interior of the U-shaped bar are led into the characters through opening 13 in the back of the character. After the welding has taken place, the U-shaped channel has an enclosed box shape of high stability and the character itself, which is welded both at its bottom and at its rear to the bar, is likewise made exceptionally stable. The time required for this type of fixing is only a fraction of the time required for traditional arrangements.

If the front face of the bar is not covered by the character rear wall in some areas, this can be easily remedied, as shown in FIG. 3, by an additional plate 14, which is either fitted into a prepared aperture, is screwed, or is welded at points 15 and 16 to the bar 9 in the same way as the characters themselves a plane portion of the plate being secured to the bent-over marginal portion of the upper limb of the bar and an out-turned lower edge portion being secured to the projecting marginal portion of the lower edge of the bar.

I claim:

1. An advertising sign assembly comprising a horizontally extending U-shaped channel having a vertical back portion, an upper limb portion extending horizontally forwardly from said back portion and having at its forward edge a vertical marginal portion and a lower limb portion extending horizontally from said back portion a greater distance than said upper limb portion to provide a marginal portion projecting beyond said marginal portion of said upper limb portion of the channel, and a plurality of three dimentional characters mounted on and supported by said channel, said characters resting on and being secured to said projecting marginal portion of said lower limb portion of said channel and resting against and being secured to said vertical marginal portion of said upper limb portion of said channel.

2. An advertising sign assembly according to claim 1, in which said characters are box-type with removable fronts and in which back and bottoms of said characters are welded respectively to said vertical marginal portion and said projecting marginal portion respectively of said channel.

3. An advertising sign assembly according to claim 1, in which said characters are box-type with removable fronts and with backs having holes opening into said channel for passage of electrical cables.

4. An advertising sign assembly according to claim 1, in which said characters are spaced from one another along said channel and in which cover panels are secured to the front of said channel between characters to close said channel.

5. An advertising sign assembly according to claim 4, in which each said panel has a plane portion welded to said vertical marginal portion and an out-turned lower edge portion welded to said projecting marginal portion of said channel.

* * * * *